US009016713B2

(12) United States Patent
Wøllo et al.

(10) Patent No.: US 9,016,713 B2
(45) Date of Patent: Apr. 28, 2015

(54) SKI BINDING

(71) Applicant: Rottefella AS, Klokkarstua (NO)

(72) Inventors: Even Wøllo, Næersnes (NO); Thomas Holm, Oslo (NO); Aksel Pettersen, Heer (NO); Øyvar Svendsen, Oslo (NO)

(73) Assignee: Rottefella AS, Klokkarstua (NO)

( * ) Notice: Subject to any disclaimer, the term of this patent is extended or adjusted under 35 U.S.C. 154(b) by 0 days.

(21) Appl. No.: 14/351,220

(22) PCT Filed: Oct. 12, 2012

(86) PCT No.: PCT/NO2012/050199
§ 371 (c)(1),
(2) Date: Apr. 11, 2014

(87) PCT Pub. No.: WO2013/055231
PCT Pub. Date: Apr. 18, 2013

(65) Prior Publication Data

US 2014/0284901 A1 Sep. 25, 2014

(30) Foreign Application Priority Data

Oct. 14, 2011 (NO) ..... 20111394

(51) Int. Cl.
*A63C 9/00* (2012.01)
*A63C 9/06* (2012.01)
(Continued)

(52) U.S. Cl.
CPC ... *A63C 9/06* (2013.01); *A63C 9/02* (2013.01); *A63C 9/245* (2013.01); *A63C 2201/06* (2013.01)

(58) Field of Classification Search
CPC ..... A53C 9/00
USPC ..... 280/11.23, 611–637
See application file for complete search history.

(56) References Cited

U.S. PATENT DOCUMENTS 7,246,812 B1 * 7/2007 Ayliffe ..... 280/615
7,988,180 B2 * 8/2011 Holzer et al. ..... 280/616
(Continued)

FOREIGN PATENT DOCUMENTS

DE 103 19 675 A1 11/2003
EP 1 790 396 A2 5/2007

OTHER PUBLICATIONS

International Search Report for PCT/NO2012/050199, mailed May 17, 2013; ISA/EP.

(Continued)

*Primary Examiner* — John Walters
*Assistant Examiner* — James Triggs
(74) *Attorney, Agent, or Firm* — Harness, Dickey & Pierce, PLC

(57) ABSTRACT

The invention relates to a ski binding (1) for fastening a ski boot, comprising a front retainer (2); a rear retainer (3); a tensioning mechanism (20) acting between the front and the rear retainer whereby the ski boot can be clamped between the front (2) and the rear (3) retainer in such a way as to allow the heel to be lifted freely; a front sole support device (6) arranged at or by the front retainer (2), the front sole support device being pivotal about the horizontal transverse axis (7) relative to the front retainer (2); and a locking element (8) adapted to fix the front sole support device (6); wherein the locking element (8) is adapted to lift the front sole support device (6) into contact with the front part of the ski boot such that the front sole support device (6) is fixed between the locking element (8) and the front part of the ski boot.

20 Claims, 6 Drawing Sheets

(51) Int. Cl.
*A63C 9/02* (2012.01)
*A63C 9/24* (2012.01)

(56) References Cited

U.S. PATENT DOCUMENTS

| | | | | |
|---|---|---|---|---|
| 2003/0155742 | A1 | 8/2003 | Riedel et al. | |
| 2004/0207177 | A1* | 10/2004 | Riedel et al. | 280/611 |
| 2004/0262886 | A1 | 12/2004 | Girard | |
| 2007/0108736 | A1 | 5/2007 | Walker et al. | |
| 2007/0126204 | A1* | 6/2007 | Riedel et al. | 280/615 |
| 2008/0185820 | A1 | 8/2008 | Hauglin | |
| 2011/0298196 | A1* | 12/2011 | Lehner | 280/611 |

OTHER PUBLICATIONS

International Preliminary Report on Patentability for PCT/NO2012/050199, mailed Sep. 13, 2013; IPEA/EP.

Norwegian Search Report dated Apr. 18, 2012, corresponding to Patent Application No. 20111394 (Norwegian and English).

* cited by examiner

SKI BINDING

CROSS-REFERENCE TO RELATED APPLICATIONS

This application is a 371 U.S. National Stage of International Application No. PCT/NO2012/050199, filed on Oct. 12, 2012, which claims priority to Norwegian Patent Application No. 20111394 filed on Oct. 14, 2011, the contents of which are hereby incorporated by reference in their entirety as if fully set forth herein.

The present invention relates to a ski binding, in particular a touring or Telemark binding for securing a ski boot as disclosed in the preamble of claim 1.

A ski binding of this kind is known from EP1790396 B1. This known construction comprises a front retainer and a rear retainer, and a tensioning mechanism arranged between the front retainer and the rear retainer, whereby the ski boot can be clamped between the front retainer and the rear retainer in such a way as to allow the heel to be lifted freely. The front retainer may, for example, be configured as a toe piece and be pivotally supported about a horizontal transverse axis across the longitudinal axis of the binding. The ski binding further comprises a midplate or sole support device arranged pivotally about the horizontal transverse axis and relative to the front retainer, and the rear retainer is arranged on the midplate distal to the horizontal transverse axis. At or by the front retainer there is further arranged a second sole support device. The second sole support device is pivotal about the horizontal transverse axis relative to the midplate and the front retainer. The second sole support device can, if so desired, also be fixed by a locking element that can be pushed in under the locking element.

The object of this construction is to easily adjust the binding from a "touring or walking position" to a "downhill position", and vice versa, wherein the boot heel in the first position can be lifted substantially freely against the action of the tensioning mechanism acting between the front retainer and the rear retainer, whilst the lifting of the heel in the last-mentioned position is limited by the flexibility of the boot sole and by the counter-action of the tensioning mechanism acting between the front retainer and the rear retainer. In the "downhill position", the forward sole part is held fixed relative to the ski surface, whilst in the "walking position", the sole support device will conform to the arch of the boot sole when the boot heel is lifted. When also the front retainer is pivotal about the horizontal transverse axis, the front end of the boot will be held in a substantially free manner when the boot heel is lifted.

A ski binding of this kind is used typically by advanced skiers who want to ski on untouched and often steep mountainsides. To reach the top of these mountainsides, the walking position of the binding is used. Once the skier is on the top, the binding is switched to the downhill position before the skier skis down the mountainside again. The binding is often set in downhill position when the skier is on mountainsides with a steep slope, and the skier often finds it difficult to place his heel down properly in order to be secured in the downhill position at the same time as he tries to maintain his balance. In some prior art bindings, such as in U.S. Pat. No. 7,216,888 B1, the heel must be put down fully in the lower position for the binding to be lockable in the downhill position. In use in the walking position, however, snow and ice becomes packed under the sole support device. The snow and ice thus prevent the skier from putting his heel sufficiently far down to be able to lock the binding in the downhill position, and the skier must therefore take off his skis and hack the snow and ice off the binding before it is possible to set the binding in downhill position again. It is therefore an object of the present invention to provide a ski binding having downhill and walking positions, which simplifies setting the binding in the downhill position.

The ski binding according to the present invention is disclosed in claim 1 and associated dependent claims 2-15.

According to an aspect of the present invention, a ski binding 1 is provided for fastening a ski boot, comprising a front retainer 2; a rear retainer 3; a tensioning mechanism 20 acting between the front and the rear retainer, whereby the ski boot can be clamped between the front 2 and the rear 3 retainer in such a way as to allow the heel to be lifted freely; a front sole support device 6 arranged at or by the front retainer 2, the front sole support device being pivotal about the horizontal transverse axis 7 relative to the front retainer 2; and a locking element 8 adapted to fix the front sole support device 6, the locking element 8 being adapted to lift the front sole support device 6 into contact with the front part of the ski boot such that the front sole support device 6 is fixed between the locking element 8 and the front part of the ski boot.

According to another aspect of the present invention, the front sole support device 6 can be lifted into contact with the front part of the ski boot by moving the locking element 8 from a rearward position to a forward position.

According to another aspect of the present invention, the ski binding 1 further comprises a midplate 9 arranged pivotally about a horizontal transverse axis 7 and relative to the front retainer 2.

According to another aspect of the present invention, the rear retainer 3 is arranged on the midplate distal to the horizontal transverse axis 7.

According to another aspect of the present invention, the rearward position of the locking element 8 is behind or parallel to the horizontal transverse axis 7 and in front of the rear end of the midplate 9.

According to another aspect of the present invention, the forward position of the locking element 8 is in front of the horizontal transverse axis 7.

According to another aspect of the present invention, the front sole support device 6 comprises an upper portion 6.1 adapted for contact with the front part of the ski boot, a lower portion 6.3 adapted for contact with the locking element 8, and a flexor 6.2 arranged between the upper portion 6.1 and the lower portion 6.3 and adapted to allow limited rotation of the front part of the ski boot.

According to another aspect of the present invention, the locking element 8 is configured as a cam, with the sloping front edge 8.2 of the cam constituting the contact face of the locking element against the sole support device 6.

According to another aspect of the present invention, the front retainer 2 is pivotal about the horizontal transverse axis 7.

According to another aspect of the present invention, the locking element 8 lifts the upper face of the front sole support device 6 over the horizontal plane of the horizontal transverse axis 7.

According to another aspect of the present invention, the flexor 6.2 is inserted in a recess 6.4 between the upper portion 6.1 and the lower portion 6.3 of the front sole support device 6.

According to another aspect of the present invention, the flexor 6.2 can be replaced by another flexor having different elastic properties.

According to another aspect of the present invention, the binding further comprises an operating means 16, 24 connected to the locking element 8, the operating means being movable from an open position to a locking position, whereby the locking element 8 is moved from the rearward position to the forward position, and vice versa.

According to another aspect of the present invention, the operating means 16 is configured as a toggle joint, which toggle joint in bent position corresponds to the open position, whilst in extended position it corresponds to the locking position.

According to another aspect of the present invention, the operating means 24 moves the locking element 8 from the rearward position to the forward position, and at the same time clamps the ski boot between the front 2 and rear 3 retainer with the aid of the tensioning mechanism 20 acting between the front and rear retainers.

The present invention will now be described in more detail with reference to the attached drawings and exemplary embodiments. It should however be understood that the shape and structural configuration of one or more parts may be modified without departing from the scope of the present invention.

Figure 7A:
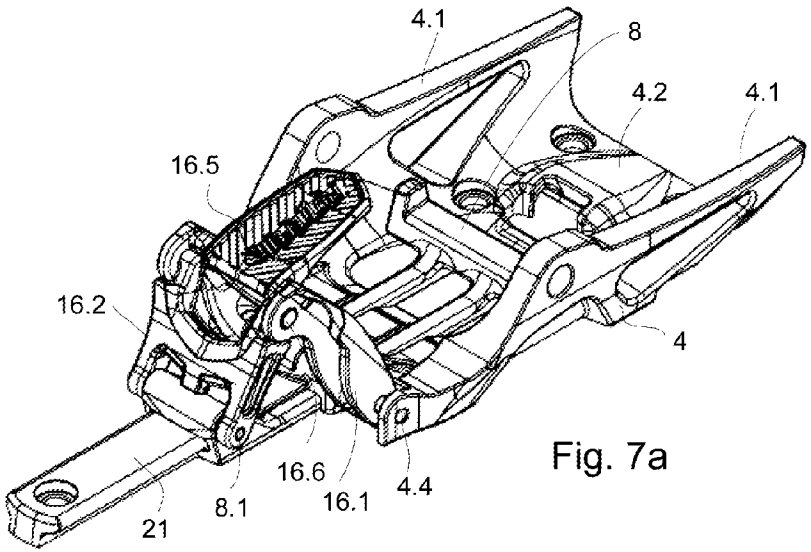
Figure 7B:
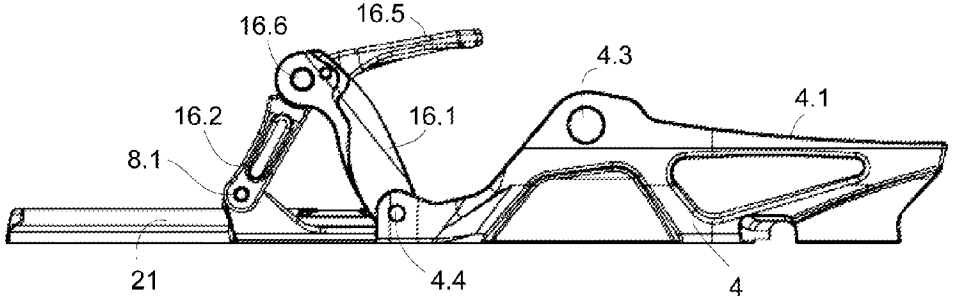
Figure 8A:
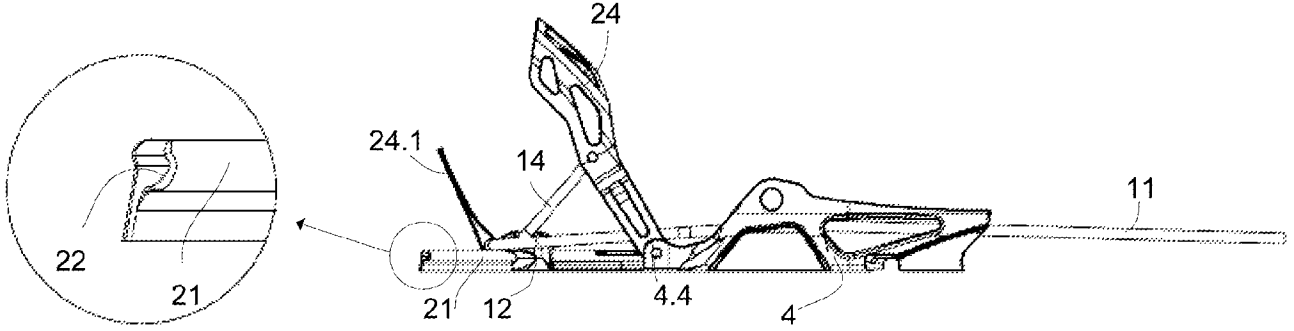
Figure 8B:
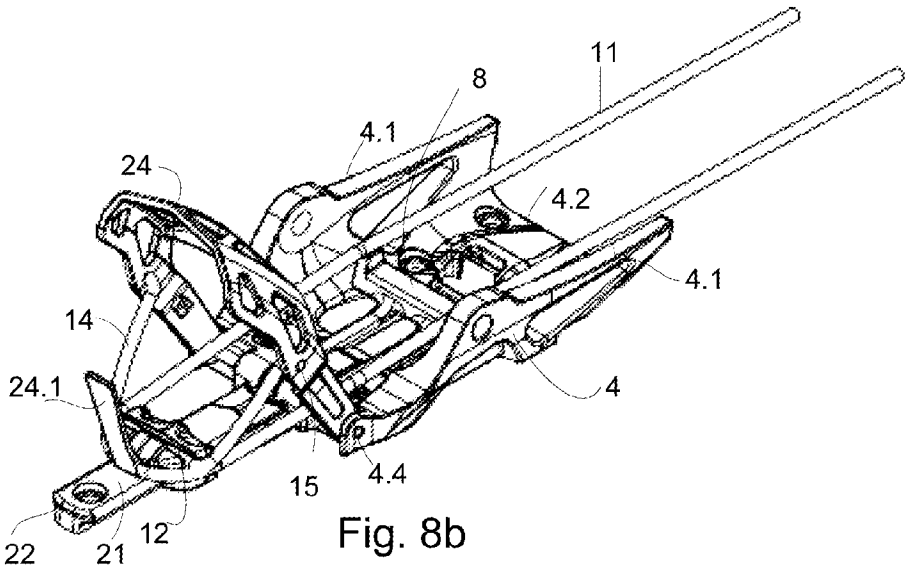

FIGS. 7*a* and 7*b* show an embodiment of a operating handle according to the present invention; and FIGS. 8*a* and 8*b* show an alternative embodiment of an operating handle according to the present invention.

The ski binding shown in FIGS. 1 to 8 can be used as a touring/cross-country binding or a Telemark binding. It is designated by the reference numeral 1. The ski binding is adapted to clamp a ski boot, which comprises a sole, between a front retainer 2 and a rear retainer 3. The ski boot is clamped between the front retainer 2 and the rear retainer 3 with the aid of a tensioning means 20 acting between the front and rear retainers in such a way as to allow the heel to be lifted freely. The ski boot, not shown, is typically a Telemark boot with an NTN (New Telemark Norm) or 75 mm sole.

In connection with the embodiment shown in FIGS. 1-6, this binding 1 also comprises a front retainer 2 and a rear retainer 3, between which a ski boot can be secured against the action of two compression springs 10 arranged in a spring housing 5. The compression springs 10 are operationally connected to respectively the rear retainer 3 and a tension cable 11, which tension cable 11 is laid around a forward cable tensioning means 12. This cable tensioning means 12 is displaceable in the longitudinal direction of the binding, or the ski, and displacement of the cable tensioning means 12 takes place with the aid of an operating lever 13 pivotal about a horizontal transverse axis. Specifically, a transfer arm 14 is arranged between the operating lever 13 and the cable tensioning means 12. This transfer arm 14 is supported pivotally in the operating lever 13 about a horizontal transverse axis 15. On forward displacement into the closed position of the binding, the cable tensioning means 12 is locked in the forward position and keeps the ski boot secured independent of whether the binding is set in the downhill or walking position.

The rear retainer 3 is configured as a forward facing retaining clamp for gripping about a backward facing sole projection arranged on the sole's heel or behind the forefoot, and movable in a forward direction with the aid of the operating lever 13 and the tension cable 11 and against the action of the said compression springs 10 in the spring housing 5. In an exemplary embodiment, this movement takes place also against the action of an additional spring member 15 disposed between a midplate 9 arranged between the front and the rear retainer. An exemplary tensioning mechanism 8 acting between the front and the rear retainer according to the present invention therefore comprises the elements described above with reference to FIGS. 1-6.

Figure 1:
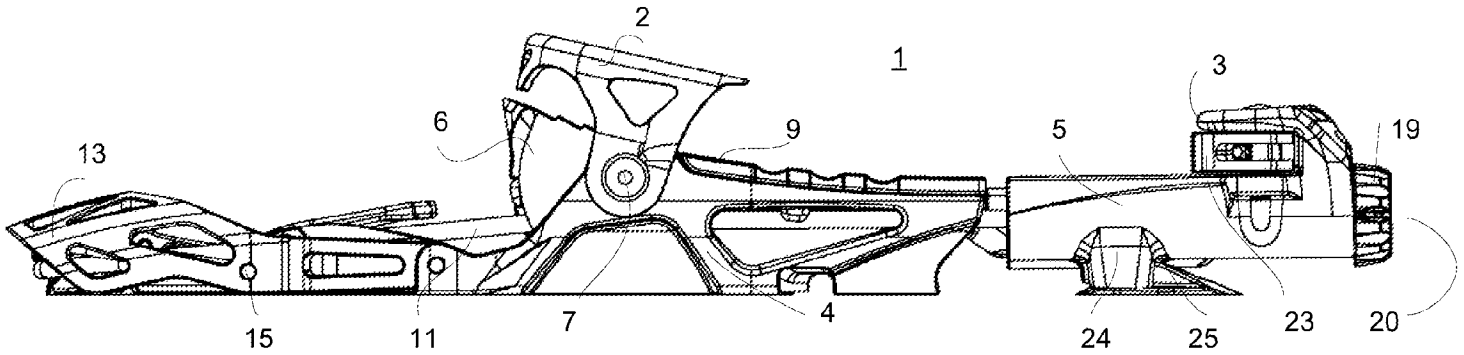
FIG. 1 is a side view of an embodiment of a ski binding according to the present invention.
Figure 2:
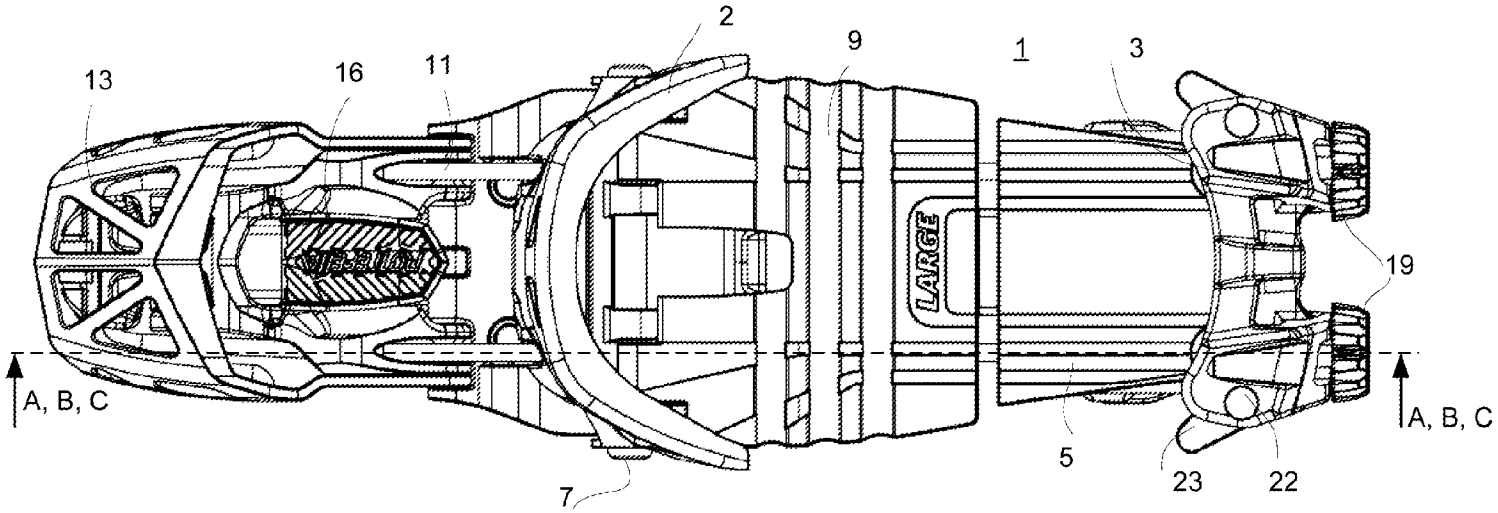
FIG. 2 is top view of the ski binding in FIG. 1.

FIGS. 1 and 2 further show the base plate 4 of the ski binding, a locking element 6 and an operating means 16. The base plate 4 is mounted on the ski by fasteners, such as screws or the like, and has side members 4.1 which extend upwards from the bottom 4.2 of the base plate. On each side member 4.1 at the forward part of the side members 4.1, there are provided openings 4.3 adapted for passage of a pin or bolt 17. The centre axis between the openings 4.3 defines a horizontal transverse axis 7 across the longitudinal direction of the binding. The front retainer 2 is arranged pivotally about the horizontal transverse axis 7 with the aid of the pin 17. The side members 4.1 of the base plate may, in an exemplary embodiment, further provide sufficient sole support for use of the binding. In this case, the sole support is static and will not be capable of following the movements of the sole as the heel is lifted.

For a more dynamic sole support, there is, in another exemplary embodiment, further provided a midplate or sole support device 9 on the base plate 4. The midplate 9 is arranged pivotally about the horizontal transverse axis 7 and relative to the front retainer 2. In the binding shown in FIGS. 1-6, the midplate is fastened to the base plate 4 by means of the pin 17.

In the exemplary ski binding 1 shown in FIGS. 1-6, the rear retainer 3 is arranged distally on the midplate 9. In the embodiment shown in FIG. 3, the midplate 9 is provided with a backward facing portion 9.1 adapted to be inserted into a corresponding opening 5.1 in the spring housing 5, a spring element 15 being arranged between the end of the backward facing portion 9.1 and the opening 5.1. The spring element 15 is biased in the same way as the compression springs 10 by the operating lever 13 and the tension cable 11, and serves to push the rear retainer 3 backwards when the binding is opened to facilitate stepping out of the binding 1.

Figure 3:
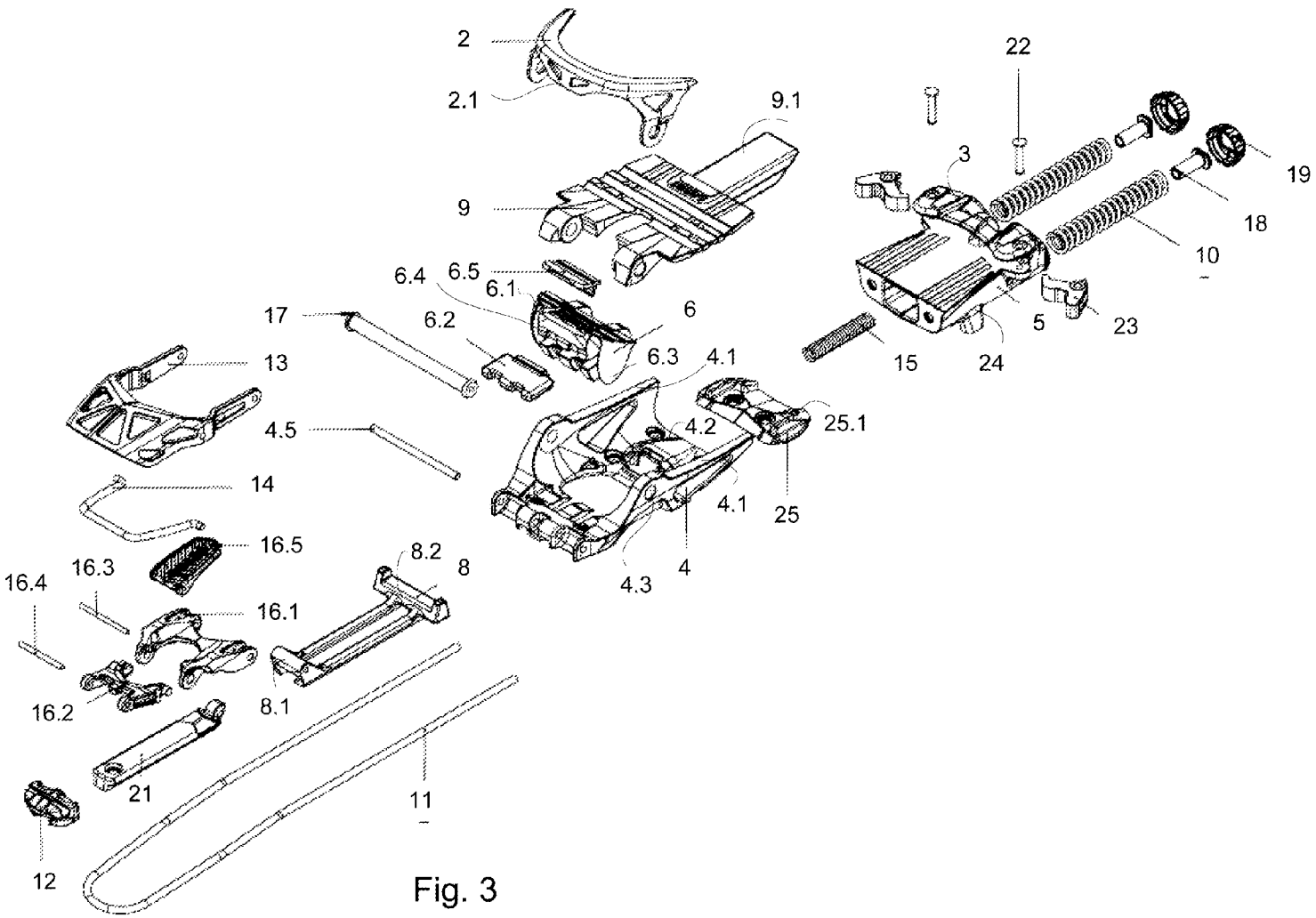
FIG. 3 is an exploded view of the ski binding in FIG. 1.

Multiple factors play a role in how a user finds a ski binding during use, such as the user's experience, skiing style, weight and the user's own preferences. The optimal setting of the binding is thus not given in advance and it should therefore be easy for a user to set the binding. An important factor in the setting of the binding, especially in the downhill position, is the biasing of the compression springs 10. The compression springs 10 are arranged inside a cavity in the spring housing 5 such that one side of the compression spring bears against a wall inside the cavity in the spring housing 5. The tension cable 11, provided with external threads on the ends thereof, runs through the cavities in the spring housing 5 and through the compression springs 10 to bushings 18. The bushings 18 are provided with internal threads adapted to the threads of the tension cable 11, and contact faces against the other side of the compression spring 10. The biasing of the compression springs 10 can therefore be adjusted by screwing the bushings 18 inwards or outwards on the threads of the tension cable. In use, the bushings 18 are however usually covered by caps 19, and the adjustment of the biasing of the compression springs 10 is then carried out by turning the caps 19. In an exemplary embodiment according to the present invention, the caps are configured with an internal depression adapted to the outer edges of the bushings' 18 contact faces, such that turning of the caps 19 effects a corresponding turning of the bushings 19. In FIG. 3 the internal depression in the caps 19 is configured with two straight side faces and end pieces that follow the curvature of the caps 19.

Although the rear retainer 3 in FIGS. 1 to 6 is shown as arranged on the midplate 9, it should be understood that the rear retainer 3 as described above can instead be fastened solely to the tension cable 11. The spring housing 5 will then not comprise the opening 5.1 and the spring element 15, but will function and be adjusted in the same way as the rear retainer described above.

At or by the front retainer 2 there is further arranged a front sole support device 6. The front sole support device 6 is pivotal about the horizontal transverse axis 7 relative to the midplate 9 and the front retainer 2. The front sole support device 6 can, if so desired, to be fixed by a locking element 8 which can be pushed in under the front sole support device 6 and prevent it from rotating about the horizontal transverse axis 7. The binding is in downhill position when the front sole support device 6 is prevented from rotating about the horizontal transverse axis 6, and in the walking position when the front sole support device 6 is free to rotate about the horizontal transverse axis 7. The locking element 8 according to the present invention is adapted to lift the front sole support device 6 into contact with the front part of the ski boot such that the front sole support device 6 is fixed between the locking element 8 and the front part of the ski boot.

Figure 4:
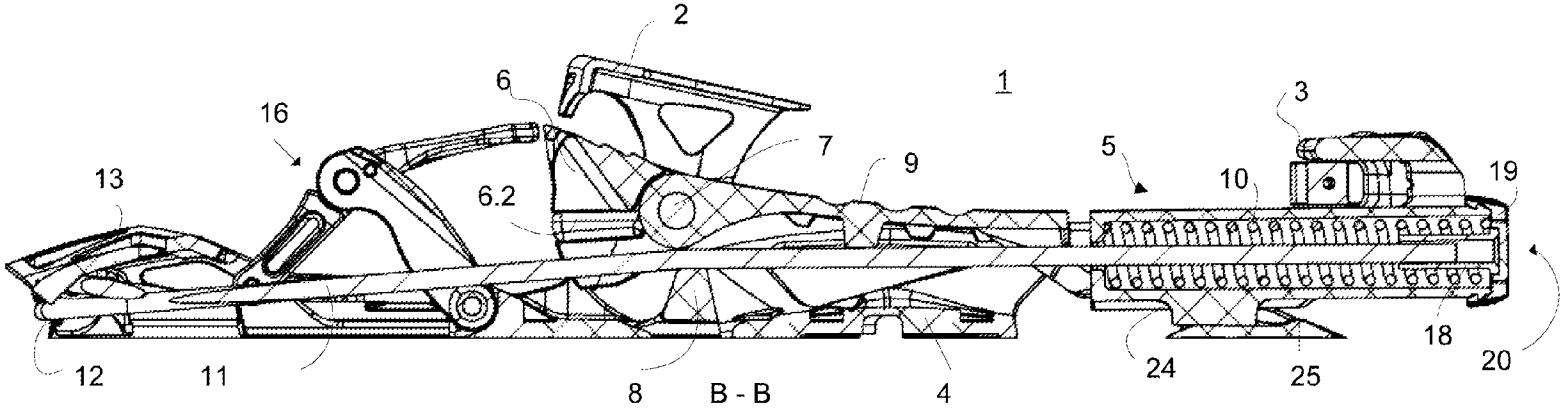
FIG. 4 shows a longitudinal section of the ski binding in FIGS. 1-3 in downhill position.
Figure 6:
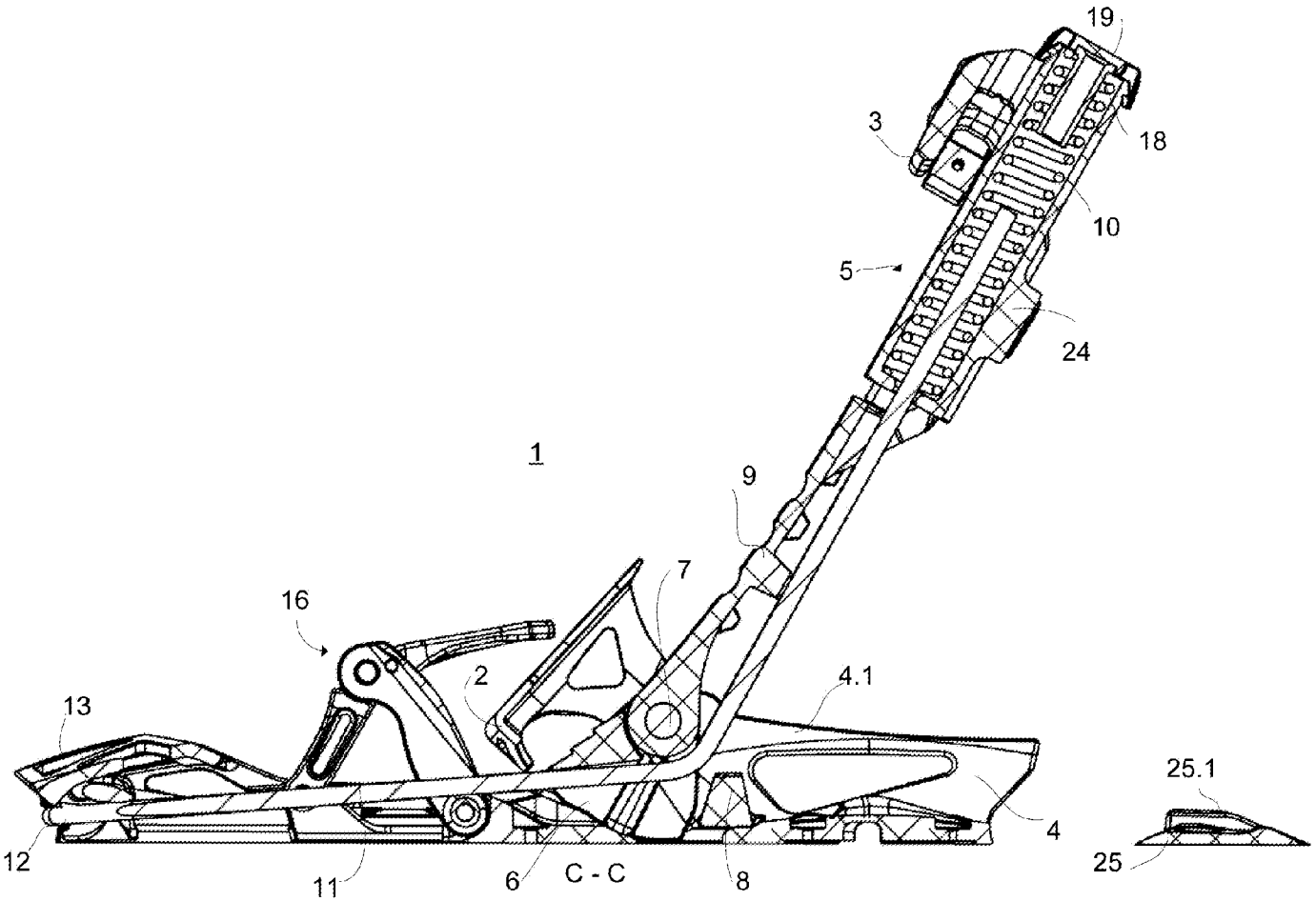
FIG. 6 shows a longitudinal section of the ski binding in FIGS. 1-5 in walking position, with the rear retainer in a lifted position.

FIG. 4 is a longitudinal section of the ski binding 1 in walking position with the rear retainer 3 in the lower position. The rear retainer 3 is pushed forwards by means of the operating lever 13 and the tension cable 11 and against the action of the compression springs 10 in the spring housing 5 as described in detail above. The locking element 8 is in a rearward position, behind the horizontal transverse axis 7. In other embodiments, the rearward position can be parallel with or in front of the horizontal transverse axis 7. In the walking position, the front sole support device 6 is free to rotate about the horizontal transverse axis 7 and relative to the front retainer 2 and the midplate 9, together with the front part of the ski boot. As the heel of the ski boot is lifted, the front retainer 2 is pressed downwards and backwards, as shown in FIG. 6, where the ski binding 1 is shown in longitudinal section in the walking position with the rear retainer 3 in a lifted position.

Figure 5:
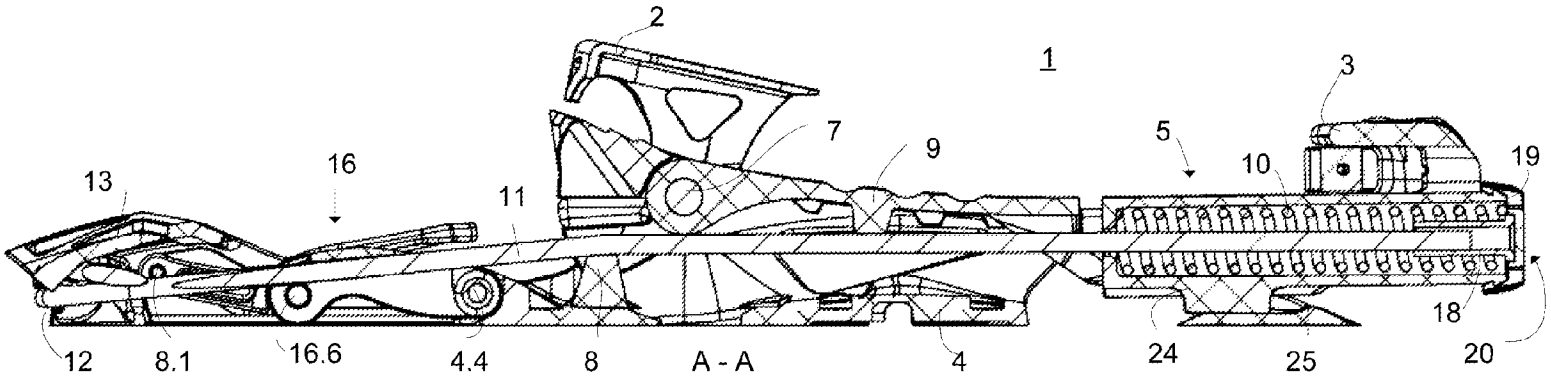
FIG. 5 shows a longitudinal section of the ski binding in FIGS. 1-4 in walking position, with the rear retainer in its lower position.

FIG. 5 is a longitudinal section of the ski binding in downhill position with the rear retainer 3 in the lower position. The rear retainer 3 is pushed forwards by means of the operating lever 13 and the tension cable 11 and against the action of the compression springs 10 in the spring housing 5 as described in detail above. The front sole support device 6 here has been lifted into contact with the front part of the ski boot by moving the locking element 8 from the rearward position to a forward position, in front of the horizontal transverse axis 7, such that the front sole support device 6 is fixed between the locking element 8 and the front part of the ski boot, that is to say, the sole support device 6 is prevented from rotating about the horizontal transverse axis 7.

In an exemplary embodiment, the locking element 8 is connected to an operating means 16, which operating means 16 is movable from an open position to a locking position, and vice versa. With the operating means 16 in open position, the binding 1 is in the walking position, whilst the binding 1 is in the downhill position when the operating means 16 is in the locking position. As the locking element 8 is, with the aid of the to operating means 16, moved forwards from the rearward position, the locking element 8 comes into contact with a lower portion 6.3 of the front sole support device 6 whereby the sole support device 6 is gradually lifted until the locking element is in the forward position and the sole support device has reached its highest position. The locking element 8 can, in one exemplary embodiment, be configured as a transverse cam, with the sloping front edge 8.2 of the cam constituting the contact face of the locking element against the front sole support device 6. The lower portion 6.3 of the front sole support device can, in exemplary embodiments, be configured as an inclined plane or be rounded and adapted to the contact face 8.2 of the locking element.

When the front sole support device 6 is lifted into contact with the front part of the ski boot, the rear part, or heel, of the ski boot is at the same time pushed downwards and thus presses the ski boot downwards, which helps the skier to set the binding in the downhill position.

In an exemplary embodiment according to the present invention, the locking element 8 lifts the upper face of the front sole support device over the horizontal plane of the horizontal transverse axis 7, that is to say, as shown in FIGS. 1 and 5, that the upper face of the front sole support device 6 points upwards and forwards relative to the horizontal plane of the transverse axis 7. For a ski boot fixed between the front sole support device 6 and the front retainer 2, the toe will then point upwards and the heel is pressed downwards, which gives an effective biasing of the heel when lifting the heel in an angle range in which the compression springs 10 usually effect insufficient biasing.

According to an exemplary embodiment, the front sole support device 6 may be a rigid element. In another exemplary embodiment, as shown in FIGS. 3-6, the front sole support device 6 further comprises an upper portion 6.1 adapted for contact with the front part of the ski boot, a lower portion 6.3 adapted for contact with the locking element 8 and a flexor or flexible resilient element 6.2 arranged between the upper portion 6.1 and the lower portion 6.3 and adapted to allow limited rotation of the front part of the ski boot when the front sole support device 6 as a whole is prevented from rotating by the locking element 8. The flexor 6.2 may be an integral part of the front sole support device 6 or be inserted in a recess 6.4 between the upper portion 6.1 and the lower portion 6.3 of the front sole support device 6. Having the flexor 6.2 inserted in a recess makes it possible, without tools, to replace the flexor with another flexor having different elastic properties. In this way the properties of the binding can easily be changed and tried out.

In yet another embodiment, a metal piece 6.5 is arranged right at the front and on top of the upper portion 6.1 of the front sole support device. This metal piece 6.5 serves as contact face for a downward facing projection 2.1 in the front retainer 2 and limits the maximum possible rotation of the front retainer 2.

FIGS. 7*a* and 7*b* show an exemplary operating means 16 according to the present invention, where the operating means 16 is configured as a toggle joint. In the figures, the toggle joint is shown in the bent position, which corresponds to the open position for the operating means, the locking element 8 is in the rearward position and the binding is in the walking position. The toggle joint comprises a first joint member 16.1, fastened on one side to the base plate 4 in a forward position 4.4 by a pin or bolt 4.5, and fastened on the other side to one of the sides of the second joint member 16.2 by a pin or bolt 16.3 in the central articulation 16.6. The other side of the second joint member 16.2 is fastened to the locking element 8 by a pin or bolt 16.4 via a connection point 8.1 positioned ahead of the locking element 8 itself. The locking element 8 is slidingly arranged over a guiding face 21, which guiding face is also fastened to the base plate 4 in the forward position 4.4 by the pin or bolt 4.5. By depressing the central articulation 16.6, the toggle joint is straightened into the extended position corresponding to the locking position of the operating means, that is to say, that the locking element 8 is in the forward position and the binding 1 is in the downhill position. In FIG. 5, the operating means 16 is shown in locking position, where the central articulation 16.6 is in a position below the centre line between the connection points 8.1 and 4.4 such that the operating means 16 does not need additional fastening means to remain in the locking position. To return to the walking position, the central articulation 16.6 must be lifted, for example, by pulling a strap 16.5 fastened to the central articulation 16.6.

FIGS. 8*a* and 8*b* show another exemplary operating means 24 according to the present invention. In this embodiment, movement of the locking element 8 is operated using the same operating lever as the fastening of the ski boot in the binding 1. As described above, the tension cable 11 is laid around a front cable tensioning means 12. This cable tensioning means 12 is displaceable in the longitudinal direction of the binding, or the ski, and the displacement of the cable tensioning means 12 is effected with the aid of an operating means 24 that is supported pivotally about a horizontal transverse axis. Specifically, a transfer arm 14 is arranged between the operating means 24 and the cable tensioning means 12. This transfer arm 14 is supported pivotally in the operating means 24 about a horizontal transverse axis 15. On forward displacement to the closed position of the binding, the tension cable 11 is fastened in a recess 22 at the front of the guiding face 21, whereby the ski boot is held fixed independent of whether the binding is set in the downhill or walking position. The tension cable 11 can be freed by, for example, pulling on a strap 24.1, whereby the ski boot is released. In this exemplary embodiment, the cable tensioning means 12 is fastened to the locking element 8, and the locking element 8 is moved forwards or backwards between the forward and rearward position by moving the operating means 24 between the locking position and the open position, respectively.

Reference will now be made again to the embodiment in FIG. 1 to FIG. 6, and in particular to that shown in FIG. 2 and FIG. 3. This embodiment differs from that described above only in that the rear retainer 3 comprises two clamps pivotally supported about an upright axis 22 that engage with a backward facing sole projection, namely in the top view roughly L-shaped retaining clamps 23, which when actuated by a pre-determined lateral torque against the boot can be pivoted outwards against the action of resilient elements, in particular torsion spring elements.

A problem frequently encountered when using prior art bindings is that the user often does not put his foot and ski boot far enough forward when stepping into the binding 1, e.g., because of snow under the boot, such that the rear retainer 3 does not grip around the backward facing sole projection of the ski boot, but typically encounters the rear retainer 3 itself. If the user then tightens the binding, this can result in excessive loading of the springs 10 and/or the operating means 16. To solve this problem, there is, in another embodiment of the present invention, provided a support plate 25 mounted on the ski with fasteners, such as screws or the like, behind the base plate 4 and under the spring housing 5 at or by the rear retainer 3. The support plate 25 also has two projections or guides 25.1 that extend upwards from the ski surface towards the spring housing 5. The guides 25.1 are almost flat on the top and slope gently backwards. On the underside of the spring housing 5 there are arranged corresponding projections 24 adapted to be passed on the outside of the guides 25.1. In open position, the projections 24 are behind the guides 25.1, and as the tension cable 11 is tensioned, the spring housing 5, and with it the projections 24, will move forward and slide up the sloping faces of the guides 25.1 whereby the spring housing 5, and thus the rear retainer 3, are lifted up towards the sole projection. By lifting the rear retainer 3, the user does not need to put his foot and ski boot so far forward, and stepping into the binding 1 is simplified considerably compared to the prior art. Furthermore, the projections 24 also lie in contact with the guides 25.1 when the heel is lowered, which serves to take up torsional forces transverse to the binding and improves the stability of the binding, especially during turning movements.

The invention claimed is:

1. A ski binding for fastening a ski boot, comprising:

a front retainer;

a rear retainer;

a tensioning mechanism acting between the front and the rear retainer, whereby the ski boot is clamped between the front and the rear retainer in such a way as to allow the heel to be lifted freely;

a front sole support device arranged at or by the front retainer, the front sole support device being pivotal about the horizontal transverse axis relative to the front retainer;

a locking element adapted to fix the front sole support device;

the locking element is adapted to lift the front sole support device into contact with the front part of the ski boot such that the front sole support device is fixed between the locking element and the front part of the ski boot;

wherein the front sole support device is lifted into contact with the front part of the ski boot by moving the locking element from the rearward position to a forward position;

the rearward position of the locking element is behind or parallel to the horizontal transverse axis and in front of the rear end of the midplate;

the forward position of the locking element is in front of the horizontal transverse axis.

2. The ski binding according to claim 1, wherein the ski binding further comprises a midplate arranged pivotally about a horizontal transverse axis and relative to the front retainer.

3. The ski binding according to claim 2, wherein the rear retainer is arranged on the midplate distal to the horizontal transverse axis.

4. The ski binding according to claim 1, wherein the front sole support device comprises:

an upper portion adapted for contact with the front part of the ski boot;

a lower portion adapted for contact with the locking element; and a flexible resilient member arranged between the upper portion and the lower portion and adapted to allow limited rotation of the front part of the ski boot.

5. The ski binding according to claim 1, wherein the locking element is configured as a cam, with the sloping front edge of the cam constituting the contact face of the locking element against the sole support device.

6. The ski binding according to claim 4, wherein the front retainer is pivotal about the horizontal transverse axis.

7. The ski binding according to claim 1, wherein the locking element lifts the upper face of the front sole support device over the horizontal plane of the horizontal transverse axis.

8. The ski binding according to claim 4, wherein the flexible resilient member is inserted in a recess between the upper portion and the lower portion of the front sole support device.

9. The ski binding according to claim 8, wherein the flexible resilient member is replaced by another flexible resilient member having different elastic properties.

10. The ski binding according to claim 1, wherein the binding further comprises an operating means connected to the locking element, the operating means being movable from an open position to a locking position, whereby the locking element is moved from the rearward position to the forward position, and vice versa.

11. The ski binding according to claim 10, wherein the operating means is configured as a toggle joint, the toggle joint in bent position corresponding to the open position and the toggle joint in extended position corresponding to the locking position.

12. The ski binding according claim 10, wherein the operating means moves the locking element from the rearward position to the forward position, and at the same time clamps the ski boot between the front and rear retainer with aid of the tensioning mechanism acting between the front and rear retainers.

13. A ski binding for fastening a ski boot, comprising:

a tensioning mechanism acting between a front retainer and a rear retainer, whereby the ski boot is clamped between the front and the rear retainer in such a way as to allow the heel to be lifted freely;

a front sole support device arranged at or by the front retainer, the front sole support device being pivotal about the horizontal transverse axis relative to the front retainer;

an operating means connected to a locking element, the operating means being operable to move the locking element from a first position to a second position;

the locking element adapted:

to fix the front sole support device; and to, in response to the operating means moving the locking element from the second position to the first position, lift the front sole support device into contact with the front part of the ski boot such that the front sole support device is fixed between the locking element and the front part of the ski boot.

14. The ski binding according to claim 13, wherein the second position is a rearward position and the first position is a forward position.

15. The ski binding according to claim 14, wherein the rearward position of the locking element is behind or parallel to the horizontal transverse axis and in front of the rear end of the midplate and the forward position of the locking element is in front of the horizontal transverse axis.

16. The ski binding according to claim 13 wherein the operating means is configured as a toggle joint, the toggle joint in bent position corresponding to the open position and the toggle joint in extended position corresponding to the locking position.

17. The ski binding according to claim 13 wherein the binding is in a walking position when the locking element is in the second position and wherein the binding is in a downhill position when the locking element is in the first position.

18. The ski binding according to claim 13, wherein the front sole support device comprises:

an upper portion adapted for contact with the front part of the ski boot;

a lower portion adapted for contact with the locking element; and a flexible resilient member arranged between the upper portion and the lower portion and adapted to allow limited rotation of the front part of the ski boot.

19. The ski binding according to claim 18, wherein the front retainer is pivotal about the horizontal transverse axis.

20. The ski binding according to claim 18, wherein the flexible resilient member is inserted in a recess between the upper portion and the lower portion of the front sole support device.

* * * * *